US009932781B2

(12) United States Patent
Hered

(10) Patent No.: US 9,932,781 B2
(45) Date of Patent: Apr. 3, 2018

(54) CASING SPEAR WITH MECHANICAL LOCKING FEATURE

(71) Applicant: Baker Hughes Incorporated, Houston, TX (US)

(72) Inventor: William A. Hered, Houston, TX (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 986 days.

(21) Appl. No.: 14/258,863

(22) Filed: Apr. 22, 2014

(65) Prior Publication Data

US 2015/0300112 A1 Oct. 22, 2015

(51) Int. Cl.
*E21B 19/07* (2006.01)

(52) U.S. Cl.
CPC ..... *E21B 19/07* (2013.01)

(58) Field of Classification Search
CPC ..... E21B 19/00; E21B 19/07; E21B 19/10; E21B 23/00; E21B 19/06
USPC ..... 166/380
See application file for complete search history.

(56) References Cited

U.S. PATENT DOCUMENTS 8,002,045 B2 * 8/2011 Ezell ..... E21B 23/00 166/212
8,342,250 B2 * 1/2013 Blair ..... E21B 19/10 166/380
8,371,387 B2 2/2013 Blair et al.
8,985,230 B2 * 3/2015 Crow ..... E21B 23/006 166/237
2004/0216924 A1 * 11/2004 Pietras ..... E21B 19/00 175/57
2009/0273201 A1 * 11/2009 Slack ..... E21B 19/07 294/86.25
2009/0314496 A1 * 12/2009 Begnaud ..... E21B 19/07 166/380
2009/0321086 A1 * 12/2009 Zimmermann ..... E21B 19/07 166/379
2011/0284208 A1 * 11/2011 MacLeod ..... E21B 17/07 166/88.2
2012/0012303 A1 * 1/2012 Xu ..... E21B 23/00 166/88.2
2012/0111556 A1 5/2012 Palmer et al.
2012/0273232 A1 * 11/2012 O'Blenes ..... E21B 3/02 166/380
2013/0048268 A1 2/2013 Crow et al.
2013/0048273 A1 2/2013 Crow et al.
(Continued)

*Primary Examiner* — Michael Wills, III
(74) *Attorney, Agent, or Firm* — Steve Rosenblatt

(57) ABSTRACT

A surface handling tool for casing employs slips to grab the casing internally and a lock that operates mechanically in conjunction with the setting of the slips. The slips rub on the inside wall to hold an outer housing against rotation. The top sub and mandrel are rotated in tandem relative to the outer housing that is held by the rubbing of the slips on insertion. The mandrel rises when rotated to extend the slips while lock segments ratchet over a series of protrusions that are shaped to resist downward movement of the mandrel. Once slips and lock are set, subsequent rotation will not release the lock or slips. When the casing is supported on the rig floor weight can be set down and a spring compressed as the leading ramp of the top sub retracts the lock segments such that rotation to the right can then retract the slips.

28 Claims, 2 Drawing Sheets

(56) References Cited

U.S. PATENT DOCUMENTS

| | | | | |
|---|---|---|---|---|
| 2014/0151067 | A1* | 6/2014 | Hart | E21B 19/07<br>166/381 |
| 2015/0107385 | A1* | 4/2015 | Mullins | E21B 19/06<br>74/89.42 |

* cited by examiner

CASING SPEAR WITH MECHANICAL LOCKING FEATURE

FIELD OF THE INVENTION

The field of the invention is surface tubular handling equipment and more particularly to equipment that grips the tubular and locks the grip against release with rotation once initially locked until the tubular is otherwise supported and weight is set down.

BACKGROUND OF THE INVENTION

Tubular handling equipment for surface handling has in the past involved slips that can be set and a locking or anchoring device apart from the slips that was hydraulically operated. This design is shown in U.S. Pat. Nos. 8,371,387 and 8,342,250. Another design for setting slips and locking the set or releasing the lock with axial movement so that additional grips can be made for repositioning of a tubular cutter are shown in US2013/0048273 and US2013/0048268. Also of interest for use of a hydraulic torque locking mechanism in conjunction with slips is application Ser. No. 13/689,911 filed in the US on Nov. 30, 2012. US2012/0111556 sets slips with rotation of the mandrel.

These designs lacked features found in the present invention. In some locations hydraulic power may not be available so that prior designs that relied on such power could not be deployed. Other designs that set with rotation were not configured to avoid release upon subsequent rotation in either direction and created the possibility of releasing the string if rotation in the wrong direction was initiated. The present invention provides for setting the slips and locking the set with a common rotational movement, among other things. Once the tubular is gripped and the grip is locked rotation in either direction will not release the lock and for that reason will not allow the grip on the tubular to be released. Release can happen with axial movement made possible by the tubular having rig floor support coupled with rotation. These and other features of the present invention will be more readily apparent to those skilled in the art from a review of the detailed description of the preferred embodiment and the associated drawings while recognizing that the full scope of the invention is to be determined from the appended claims.

SUMMARY OF THE INVENTION

A surface handling tool for casing employs slips to grab the casing internally and a lock that operates mechanically in conjunction with the setting of the slips. The slips rub on the inside wall to hold an outer housing against rotation. The top sub and mandrel are rotated in tandem relative to the outer housing that is held by the rubbing of the slips on insertion. The mandrel rises when rotated to extend the slips while lock segments ratchet over a series of protrusions that are shaped to resist downward movement of the mandrel. Once slips and lock are set, subsequent rotation will not release the lock or slips. When the casing is supported on the rig floor, weight can be set down and a spring compressed as the leading ramp of the top sub displaces the lock segments such that rotation to the right can then retract the slips.

DETAILED DESCRIPTION OF THE PREFERRED EMBODIMENT

Figure 1:
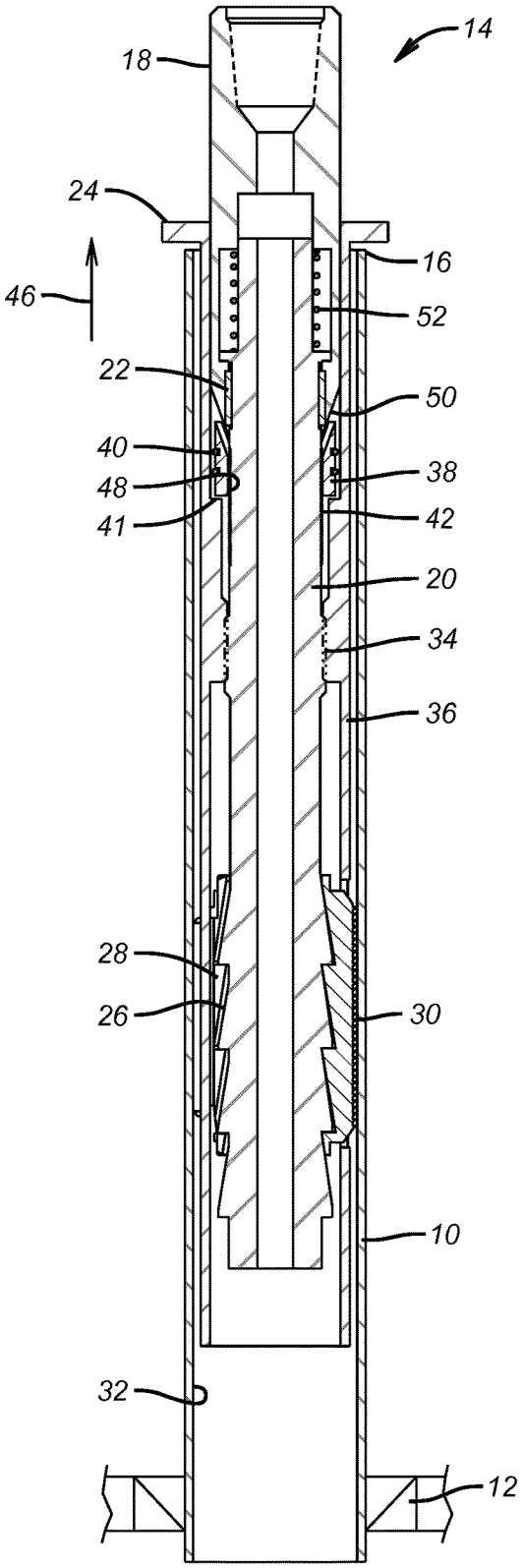
FIG. 1 is the run in position showing the tool fully inserted into a tubular.

Referring to FIG. 1, casing 10 is temporarily supported on schematically illustrated slips on a rig floor 12 when the tool 14 is run into the top 16. The tool has a top sub 18 keyed to mandrel 20 with keys 22 that allow relative axial motion between the two when weight is set down on top sub 18 and stop 24 rests on top 16. Ramps 26 engage slips 28 on axial movement of the mandrel 20. Slips 28 have wickers 30 to engage the inner wall 32 of the casing 10. Left hand thread 34 is on the mandrel 20 and the outer housing 36. Lock segments 38 are biased radially inwardly toward mandrel 20 with springs 40. Mandrel 20 has axially spaced parallel ridges 42 over which the segments 38 can jump as the mandrel is caused to move up in the direction of arrow 46. Segments 38 rest on shoulder 41 and the nature of the ridges 42 and complementary ridges 48 on segments 38 facing mandrel 20 are such that the mandrel 20 is precluded from moving axially in a direction opposite arrow 46 as long as springs 40 are pushing the segments 38 radially so that ridges 42 and 48 are in contact. As mandrel 20 moves in the direction of arrow 46 the segments 38 overcome the bias of springs 40 as ridges 48 jump over parallel ridges 42. The segments 38 are prevented from moving in the direction of arrow 46 as the mandrel 20 moves in that direction due to the presence of lower cone 50 on top sub 18. Relative movement is possible between top sub 18 and mandrel 20 if the casing 10 is supported at 12 and weight is set down to compress spring 52. Such relative axial movement is along keys 22 and has the result of advancing the cone 50 under the segments 38 to overcome springs 40 and to further separate the ridges 48 and 42. In that condition, left rotation of mandrel 20 allows slips 28 to retract as will be more fully explained below.

Figure 2:
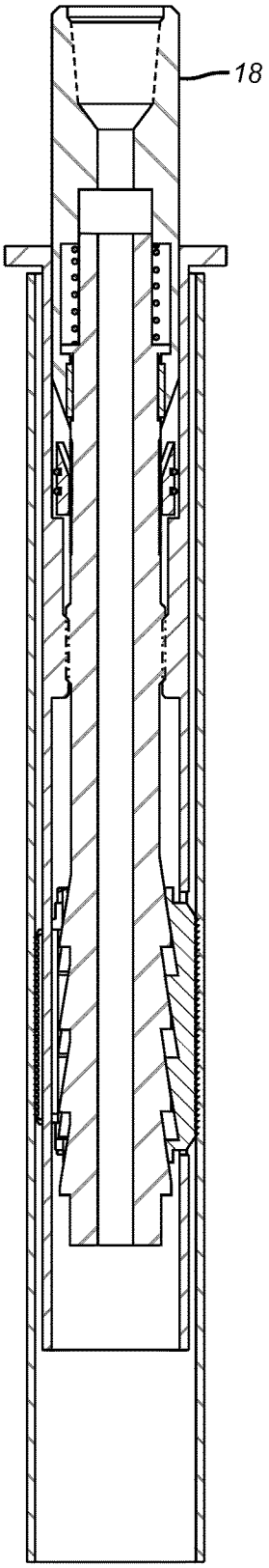
FIG. 2 is the view of FIG. 1 with the mandrel rotated right to set the slips and to lock the set.

In operation, the tool 14 is lowered to let stop 24 contact the top 16 of the tubular 10. Doing this will insert the slips 28 into the tubular 10 so that there is friction of the slips 28 against the inner wall 32 sufficient to prevent rotation of the outer housing 36 as the top sub 18 is rotated to the right. Friction forces between the stop 24 and the top of the casing 16 also contribute to preventing the rotation of the outer housing 36. Rotating top sub 18 to the right takes with it mandrel 20 as they rotate in tandem because they are keyed for tandem rotation at keys 22. Thread 34 is left handed so rotation of the mandrel 20 to the right causes mandrel 20 to rise up in the direction of arrow 46. At this time, the outer housing 36 is held against rotation by slips 28 that are lightly dragging on the inside wall 32 of the tubular 10. Mandrel 20 is allowed to move up because the profile of ridges 48 are configured to move in the direction of arrow 46 over parallel ridges 42. The segments 38 are prevented from moving in the direction of arrow 46 by the positioning of ramp 50 just above the segments 38. The set position after the rotation to the right is shown in FIG. 2 with the support at 12 removed and the weight of the tubular(s) 10 hanging on the slips 28. In this position the mandrel 20 cannot move down because the segments 38 rest on ledge 41 and springs 40 are pushing the segments 38 into mandrel 20 so that ridges 42 and 48 are engaged. In the FIG. 2 position, any rotation of the top sub 18 and with it the mandrel 42 will not release the slips 28. What will happen is that further rotation to the right will just make the slips 28 dig further into inner wall 32, while rotation to the left will simply bind the tool 14 because the segments 38 will not allow the mandrel to move in a direction opposite to arrow 46 until the segments 38 get pried away from mandrel 20. Note that in FIG. 2 the support at the rig is removed to allow running the string 10 into a borehole that is not shown. As long as weight is hanging on the slips 28 rotation to the left or to the right at top sub 18 will not allow the slips 28 to release. The string 10 can be rotated when running in or if the string 10 gets stuck it can be rotated if it is under tension. However, turning to the left with weight set down could possibly release the slips 28 in a situation where the string or tubular 10 is stuck in the hole.

Figure 3:
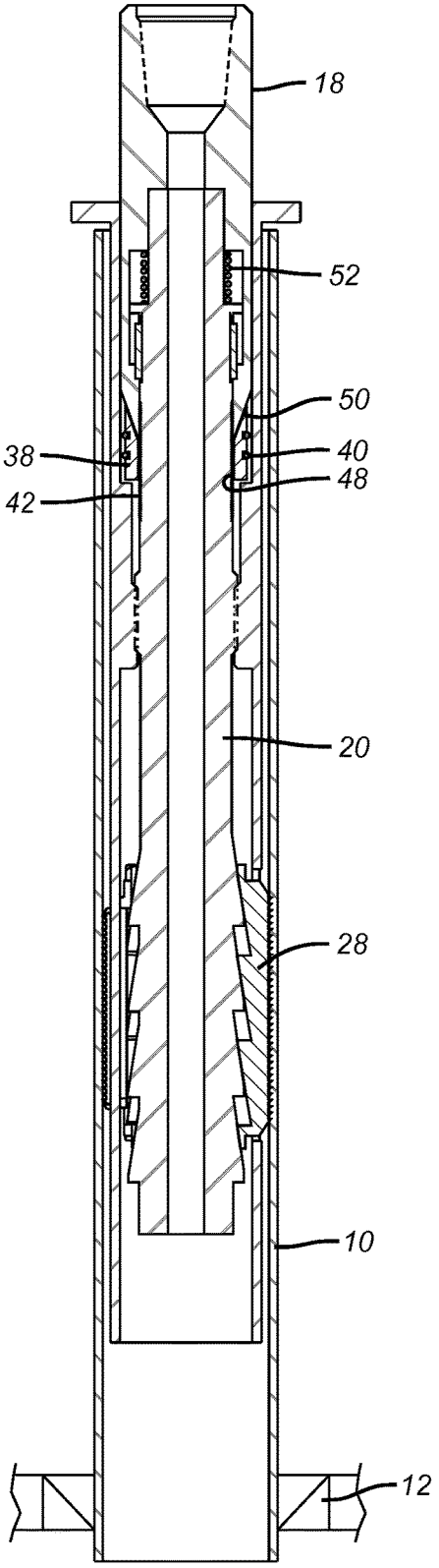
FIG. 3 is the view of FIG. 2 with the tubular supported and weight set down on the mandrel to defeat the lock.
Figure 4:
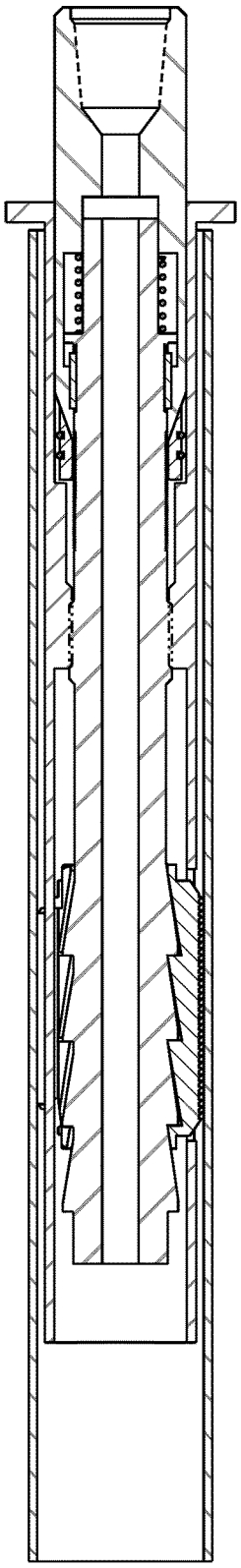
FIG. 4 is the view of FIG. 3 showing rotation to the left to retract the slips so the tool can be removed.

Release of the slips 28 is shown in FIGS. 3 and 4. As shown in FIG. 3, the support at the surface 12 is engaged and weight is set down on top sub 18 to compress spring 52 and advance ramp 50 between mandrel 20 and segments 38 so as to separate ridges 42 and 48 while extending springs 40. Once that occurs there is rotation to the left which lowers mandrel 20 so that the slips 28 can retract and the tool 14 can then be removed. That is the FIG. 4 position.

Those skilled in the art can see that the present invention will not release when supporting a string regardless of whether the tool 14 is rotated right or left. With the string supported at the surface the tool can be operated to grip the string and lock the grip with a rotation to the right. Conversely, with the string supported at the surface the tool can be set down to unlock the lock so that rotation to the left will release the slips.

The above description is illustrative of the preferred embodiment and many modifications may be made by those skilled in the art without departing from the invention whose scope is to be determined from the literal and equivalent scope of the claims below:

I claim:

1. A surface tubular handling apparatus, comprising: a mandrel; at least one slip movably mounted to said mandrel for selective radial extension and retraction of said slip with respect to said mandrel; a lock mounted to said mandrel and automatically actuated when said slip is extended against the surface tubular: said lock and said slip are actuated at least in part by rotation of said mandrel in a first direction.

2. The apparatus of claim 1, wherein:
said lock cannot release said slip from the surface tubular with surface tubular weight supported on said slip.

3. The apparatus of claim 2, wherein:
said lock cannot release with mandrel rotation with tubular weight support on said slip.

4. The apparatus of claim 1, wherein:
said mandrel is surrounded by an outer housing through which said slip extends.

5. The apparatus of claim 1, wherein:
said mandrel comprises a travel stop for positioning said slip in the tubular.

6. A surface tubular handling apparatus, comprising:
a mandrel;
at least one slip movably mounted to said mandrel for selective radial extension and retraction of said slip with respect to said mandrel;
a lock mounted to said mandrel and automatically actuated when said slip is extended against the surface tubular;
said mandrel is surrounded by an outer housing through which said slip extends;
said lock comprises a locking member that ratchets on said mandrel with respect to axial movement of said mandrel.

7. The apparatus of claim 5, wherein:
said locking member comprises a series of parallel ridges on said mandrel and said locking member.

8. The apparatus of claim 7, wherein:
said locking member prevents mandrel movement that releases said slip on rotation of said mandrel in either direction due to said parallel ridges.

9. The apparatus of claim 8, wherein:
said locking member rests on a shoulder inside said outer housing;
said locking member's positioning between parallel ridges and resting on said shoulder prevents sufficient mandrel axial movement that would release said slip.

10. The apparatus of claim 9, wherein:
said locking member is biased toward said mandrel.

11. The apparatus of claim 10, wherein:
said mandrel further comprises a selectively movable component, said component selectively separating said locking member from said mandrel so as to disengage said parallel ridges between said locking member and said mandrel.

12. The apparatus of claim 11, wherein:
said selective separation of said locking member from said component allowing mandrel rotation to retract said slip.

13. The apparatus of claim 12, wherein:
said mandrel rotates in an opposite direction when retracting said slip as when extending said slip.

14. The apparatus of claim 11, wherein:
said selectively movable component is biased away from said movable component.

15. The apparatus of claim 11, wherein:
said mandrel comprises a travel stop for positioning said slip in the tubular.

16. The apparatus of claim 9, wherein:
said lock cannot release with mandrel rotation with tubular weight support on said slip.

17. The apparatus of claim 6, wherein:
said lock cannot release with mandrel rotation with tubular weight support on said slip.

18. A surface tubular handling apparatus, comprising:
a mandrel;
at least one slip movably mounted to said mandrel for selective radial extension and retraction of said slip with respect to said mandrel;
a lock mounted to said mandrel and automatically actuated when said slip is extended against the surface tubular;
said mandrel is surrounded by an outer housing through which said slip extends;
said mandrel is movably mounted to said outer housing with a thread.

19. A surface tubular string handling method for insertion to a subterranean location, comprising: supporting the string at the surface; inserting a tool into the string; gripping the string with at least one slip and locking the grip of the slip with the same movement of a mandrel; setting said slip to grip and locking said grip at least in part with mandrel rotation; removing support for the string at the surface.

20. The method of claim 19, comprising:
preventing release of said slip when the tool is rotated in either of opposed directions with said support for the string at the surface being removed.

21. The method of claim 19, comprising: setting said slip to grip and locking said grip with axial movement of said mandrel.

22. A surface tubular string handling method for insertion to a subterranean location, comprising:

supporting the string at the surface;

inserting a tool into the string;

gripping the string with at least one slip and locking the grip of the slip with the same movement of a mandrel;

removing support for the string at the surface;

setting said slip to grip and locking said grip with mandrel rotation;

setting said slip to grip and locking said grip with axial movement of said mandrel;

using at least one locking member to lock said grip;

allowing parallel ridges on said locking member to ratchet over parallel ridges on said mandrel as said mandrel moves relatively to said locking member axially in a first direction.

23. The method of claim 22, comprising:

using an outer housing through which said slip extends;

providing a threaded connection between said outer housing and said mandrel to move said mandrel in said first direction by relative rotation of said mandrel with respect to said outer housing.

24. The method of claim 23, comprising:

locking said slip with said parallel ridges of said locking member and mandrel engaged and said locking member engaged to a shoulder on said outer housing.

25. The method of claim 24, comprising:

separating said parallel ridges to allow mandrel rotation to retract said slip.

26. The method of claim 25, comprising:

supporting said string again at the surface to allow setting down weight on said mandrel to drive a wedge between said mandrel and said locking member to separate said parallel ridges.

27. The method of claim 26, comprising:

biasing a portion of said mandrel away from said locking member;

overcoming said bias to move said portion of said mandrel that incorporates said wedge to separate said parallel ridges so that rotation of the entire mandrel retracts said slip with axial movement of said mandrel.

28. The method of claim 22, comprising:

releasing said locking member by separating said locking member from said mandrel.

* * * * *